United States Patent [19]

Tam

[11] 4,100,478

[45] Jul. 11, 1978

[54] MONOLITHIC REGULATOR FOR CML DEVICES

[75] Inventor: Richard K. Tam, Poway, Calif.

[73] Assignee: Burroughs Corporation, Detroit, Mich.

[21] Appl. No.: 772,767

[22] Filed: Feb. 28, 1977

[51] Int. Cl.[2] ..... G05F 3/08

[52] U.S. Cl. ..... 323/19; 323/22 T; 323/68; 323/1

[58] Field of Search ..... 323/1, 4, 19, 68, 22 T; 307/296, 297

[56] References Cited

U.S. PATENT DOCUMENTS

| | | | |
|---|---|---|---|
| 3,794,861 | 2/1974 | Bernacchi | 323/19 |
| 3,908,162 | 9/1975 | Marley et al. | 323/68 |
| 3,922,596 | 11/1975 | Cave et al. | 323/19 |

*Primary Examiner*—Gerald Goldberg
*Attorney, Agent, or Firm*—Joseph R. Dwyer; Mervyn L. Young; Kevin R. Peterson

[57] ABSTRACT

For coupling to a high speed logic device, a monolithic IC voltage regulator is provided which is fully compensated for variations in temperature and supply voltage. The temperature compensation is accomplished by the proper matching of resistances and current densities in shunt transistor - transistor circuitry and the compensation for variations in voltage supply is accomplished by pairs of transistors with matched current densities and high current gains (Beta) which effectively and functionally eliminates the feedback shunt transistor as a device for supplying constant base emitter voltage for the regulator output regardless of fluctuations in supply voltage thus eliminating the need to maintain current therethrough constant.

5 Claims, 1 Drawing Figure

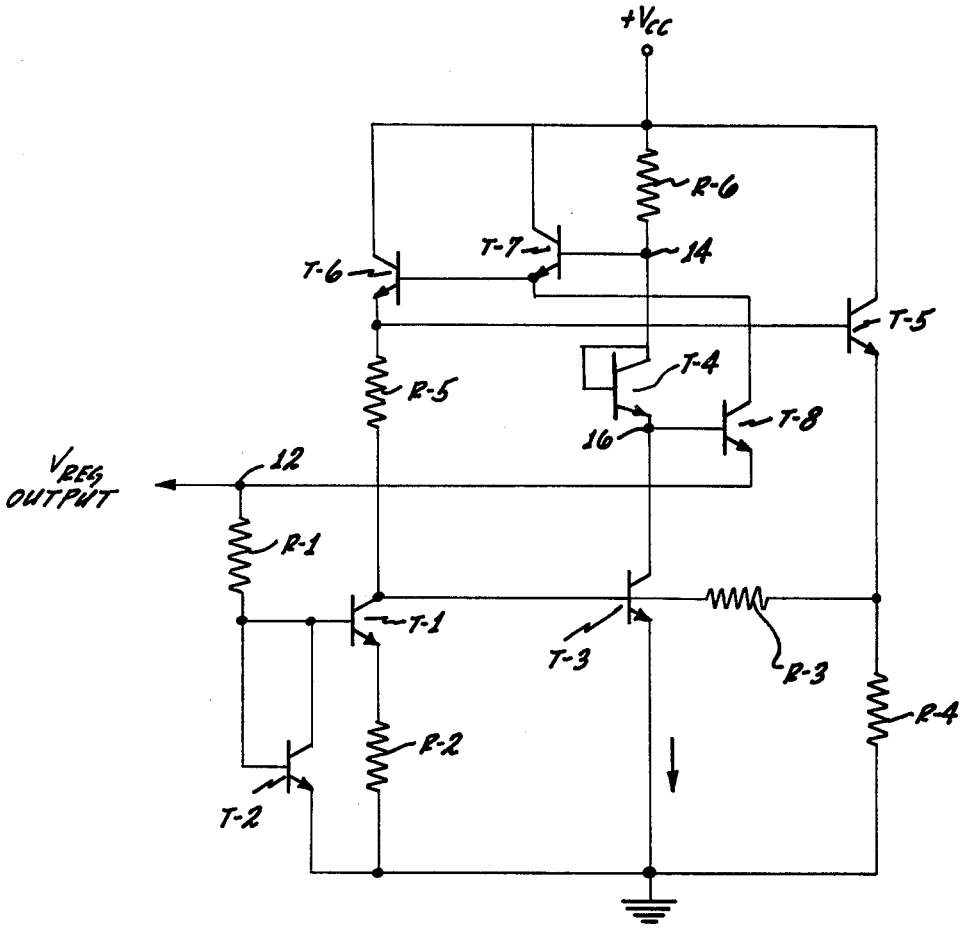
+Vcc
R-6
T-7
14
T-6
T-5
T-4
R-5
T-8
16
VREG OUTPUT
12
R-1
T-1
T-3
R-3
R-4
R-2
T-2

MONOLITHIC REGULATOR FOR CML DEVICES

BACKGROUND OF THE INVENTION

This invention relates in general to voltage regulators in integrated circuit (IC) technology and, in particular, to an IC regulator which is highly advantageous in supplying a constant current source to a current mode logic device used in high speed digital logic systems.

IC voltage regulators capable of providing a zero temperature coefficient regulated output voltage have already been developed. Such regulators have also been developed to supply a constant output voltage for logic circuits within a limited range of variations of the supply voltage. One manner of providing the constant output voltage in such regulators is to use a PNP transistor to provide the constant current in the shunt feedback transistor of the regulator. However, the disadvantage in such a system is the dependency on the absolute characteristics of the PNP transistor, which limited the voltage supply variation range because of the current limitations on the vertical PNP.

Another approach to making the prior art regulators more responsive to a wider range of fluctuations of supply voltage has been to add a feedback supply amplifier coupled to the shunt transistor which senses the changes in supply voltage and adds or subtracts from the collector current flowing through the shunt transistor so as to maintain the base emitter voltage of the shunt transistor ($V_{BE}$) constant; the shunt transistor being matched to the input transistor of a current mode logic device to which the regulator was coupled.

This invention is an improvement in voltage regulators by approaching the compensation for fluctuations in the voltage supply differently from the prior art regulators in that the shunt transistor is effectively eliminated from the regulator insofaras attempting to maintain the current through the shunt transistor constant over variations of supply voltage and performance of the regulator is dependent only on relative matching of the devices thereon.

Accordingly, it is an object to this invention to provide an IC regulator which is fully temperature and supply voltage compensated so as to be responsive to a wide range of variations in supply voltage.

It is a more specific object to this invention to provide an IC regulator which is fully temperature and supply voltage compensated yet does not depend on maintaining the current flow constant in the shunt transistor as in the prior art regulators.

SUMMARY OF THE INVENTION

The voltage regulator which accomplishes the foregoing objects comprises a feedback shunt transistor whose current density is matched with another transistor which taken together with a pair of resistances coupled thereto provide the compensation for variations in temperature and for output voltage regulation circuitry including pairs of transistors with matched current densities and high current gains are coupled to the positive supply voltage source in such a manner as to functionally eliminate the feedback shunt transistor as the device for supplying constant base emitter voltage output thus eliminating the need for maintaining the current through the feedback shunt transistor constant.

BRIEF DESCRIPTION OF THE DRAWING

The sole FIGURE of the accompanying drawing illustrates the preferred embodiment of the invention.

DESCRIPTION OF THE PREFERRED EMBODIMENT

In the single FIGURE, all the circuit elements and their connections are deposited on a chip, to form an IC, it being understood that the output voltage therefrom is supplied to an external circuit such as a current mode logic device, but the regulator circuit can be on the same semiconductor wafer as the logic device.

The regulator circuit 10 comprises a resistor R-1, NPN transistors T-1 and T-2, NPN shunt transistor T-3 and resistor R-2. One end of resistor R-1 is connected to output node 12 and at its other end to the base of the transistor T-1 and to the base of transistor T-2. The emitter of transistor T-2 is connected directly to a common source, such as ground, while its collector is connected to the base of transistor T-1 and in common with resistor R-1, with the collector and the base of transistor T-2 thus shorted, transistor T-2 forms a diode. The emitter of T-1 is also connected to ground through the aforementioned resistor R-2, while its collector is connected to the base of shunt transistor T-3. The emitter of T-3 is connected directly to ground while its collector is connected to the base of NPN transistor T-4 whose base and collector are shorted together to form a diode. The base of transistor T-3 is also connected to one end of resistor R-3 while the other end of resistor R-3 is connected to resistor R-4 in common with the emitter of an NPN transistor T-5. The other end of resistor R-4 is connected to ground. The base of transistor T-5 is connected to the emitter of T-6 and to one end of resistor R-5, the other end of resistor R-5 being connected to the collector of transistor R-1. The collector of transistor T-5 is connected to a source of positive potential Vcc.

One end of resistor R-6 is connected to Vcc and to the collector of an NPN transistor T-7 whose base is connected at node 14 to the other end of resistor R-6 opposite Vcc and whose emitter is connected to the base of NPN transistor T-6 and to the collector of an NPN transistor T-8. The collector of transistor T-6 is connected in common with the collector of transistor T-7 and to Vcc while the collector of transister T-8 is connected to the base of transistor T-6 and the emitter of transistor T-7. The base of transistor T-7 is connected at node 14 to an NPN transistor T-4 whose collector and base are shorted to form a diode as aforesaid and whose emitter is connected to the base of transistor T-3 at node 16.

For output voltage regulation to compensate for changes in temperature, the regulator 10 is essentially a well-known temperature compensated Widlar regulator. For example, any decrease in current through resistor R-3 due to an increase in temperature affecting the base emitter voltage ($V_{BE}$) of transistor T-3 having a negative temperature coefficient, is offset by a positive temperature coefficient compensation circuit comprising the combination of T-2 whose base and collector are shorted to form a diode, as aforesaid, and transistor T-1 so that the voltage across resistor R-2 will increase with temperature. Since the current through resistor R-2 and resistor R-3 flows through resistor R-5, by the proper selection of values of these resistors and the temperature coefficients of transistors T-3 and T-1, the voltage across resistor R-5 will have a zero temperature coefficient. Thus, while the current going through resistor R-3 may have a tendency to decrease with temperature, it has no effect on the current through transistor T-3.

Since the operation of temperature compensated Widlar regulators is well-known, no further description is deemed necessary herein. However, if further information is desired, reference is made to the publication entitled, "New Developments in IC Voltage Regulators," by Robert J. Widlar, IEEE Journal of Solid State Circuits, Vol. SC-6, No. 1, February 1971, FIG. 2 and the accompanying explanation of page 3 thereof.

Now as to the function of this regulator in response to variations in voltage supply (+Vcc), the basic difference between this regulator circuit and the prior art regulator circuits is that prior art circuits normally attempted to keep the emitter current $I_{T\text{-}3}$ of the shunt transistor T-3 constant over variations of temperature and voltage supply so that the output voltage at node 12 coupled to the input transistor of a CML gate (not shown) remains constant. The present regulator circuit differs in that the emitter current $I_{T\text{-}3}$ of transistor T-3 is virtually or functionally cancelled out so that it will not be the transistor used to match the external current source, such as the input transistor of the CML device.

The function of this regulator is best described in the equation $$V_{node\ 12} = V_{BE_{T\text{-}3}} + V_{R\text{-}5} + V_{BE_{T\text{-}6}} + V_{BE_{T\text{-}7}} - V_{BE_{T\text{-}4}} - V_{BE_{T\text{-}8}}$$

Transistors T-4 and T-3 are a matched pair. Similarly transistors T-7 and T-8 are a matched pair, that is, the current densities of the paired transistors are equal, and with the Beta (the current gain) of all the transistors being high (Beta equal to or greater than 50) then the base currents for transistors T-8, T-7 and T-6 are low or negligible. From this it can be seen that the emitter current $I_{T\text{-}3}$ through transistor T-3 is the same as the emitter current through transistor T-4 since such current flows through the same path except for the currents at the two nodes 14 and 16; node 14 being connected to the base of transistor T-7 and node 16 being connected to the base of transistor T-8. Likewise, the emitter current through transistor T-8 is the same as the emitter current through transistor T-7 because they are connected together and the current flows through the same path. Although the collector of transistor T-8 is joined with emitter of transistor T-7 and also at the base of transistor T-6, since the Beta of transistor T-6 is very high, there is a very high impedance at the base of T-6. So essentially the emitter current through transistor T-7 is the same as the emitter current through transistor T-8 under all circumstances regardless of what voltage is applied to the regulator because they are always in the same path. Because of that, the $V_{BE}$ of transistor T-3 is the same as the $V_{BE}$ of transistor T-4 since they have the same emitter current and the $V_{BE}$ of transistor T-8 is the same as the $V_{BE}$ of transistor T-7 by the same reasoning.

Thus, in reviewing the equation, we can subtract the $V_{BE}$ of transistor T-3 from the $V_{BE}$ of transistor T-4 and the $V_{BE}$ of transistor T-7 from the $V_{BE}$ of transistor T-8. Thus, in accordance with this equation, the voltage at node 12 is equal to the voltage across resistor R-5 plus the $V_{BE}$ of transistor T-6, and thus the foregoing equation is reduced to $$V_{node\ 12} = V_{R\text{-}5} + V_{BE_{T\text{-}6}}$$

Since the current through R-5 is constant, so the $V_{BE}$ of transistor T-6 is also constant regardless of the variation of Vcc. This means that the voltage of node 12, the regulator output voltage, is not a function of any variations of Vcc.

Perhaps it should be explained that the purpose of T-5, R-3 and R-4 in addition to the negative temperature coefficient functions is to provide a current flowing from the collector of T-1 to the emitter of T-5 which is independent of supply voltage.

From the equation $$V_{R\text{-}3} = V_{BE_{T\text{-}3}} - (V_{BE_{T\text{-}3}} + V_{R\text{-}5} - V_{BE_{T\text{-}5}}) = V_{R\text{-}5} - V_{BE_{T\text{-}5}}$$

it can be seen that the $V_{BE}$ of T-3 is cancelled out of the equation which also means that the power supply dependent variable namely T-3 has been eliminated. So, essentially, the voltage across R-3 is not a first order function of the power supply or, stated another way, is very insensitive to power supply variation.

From the above equation, it can be seen that because of the insensitivity of the voltage across R-3 to supply voltage as well as insensitivity of the voltage across R-2 to supply voltage, that the voltage across R-5 will be insensitive or not a first order function supply voltage. The reason why the voltage across R-2 is insensitive to power supply voltage is that the voltage across R-2 is a delta $V_{BE}$ between transistor T-2 and T-1 which delta $V_{BE}$ is generated from the output (node 12) the regulated output voltage held constant and not a function of power supply voltage.

And further from the equation $$V_{R\text{-}5} = V_{R\text{-}2}\,X(R\text{-}5/R\text{-}2) + V_{R\text{-}3}\,X(R\text{-}5/R\text{-}3)$$

it can be seen that the voltage drop across R-5 is insensitive to supply voltage also; $V_{R\text{-}2}$ and $V_{R\text{-}3}$ being constant.

With the current through R-2, independent of the power supply voltage, the $V_{BE}$ of transistor T-6 will also be constant and independent of power supply. Therefore, since output voltage of the regulator at node 12 is actually the $V_{BE}$ of transistor T-6 plus the voltage across R-5 both which can be insensitive to power supply voltage, the output of the regulator is also insensitive to supply voltage. In other words, if T-2 voltage is constant and T-1 voltage is constant, then, R-2 voltage is constant, and if R-2 voltage is constant, then R-5 voltage and T-6 voltage are constant. (By constant is meant not a first order function of power supply voltage fluctuation.)

From the foregoing it can be seen that the shunt transistor T-3, although performing a feedback function in the regulator, the compensation for variation and supply voltage is independent thereof and no attempt was made to maintain the current through transistor T-3 constant as in the case of prior art voltage regulators where the output from the regulator is normally taken at the node of the emitter of T-6.

What is claimed is:

1. In a voltage regulator a temperature compensating circuit so as to be insensitive to changes in temperature and connected to means providing a reference voltage and a positive supply voltage;

the improvement comprising, means including a first NPN transistor connected between said positive supply and said reference voltage;

an output node;

a supply voltage variation compensation circuit means between said positive supply voltage and said output node so that said output node is constant over variations of positive supply voltage;

said compensation circuit including matched pairs of transistors, one of said transistors of the first of said matched pair being said first NPN transistor with the second of the same matched pair having an emitter electrode connected to the collector electrode of said first transistor to establish a current path between said positive supply and said first NPN transistor, the bases of the second matched pair are also connected to the same current path while the emitter electrode of the transistor of said second matched pair is connected to the collector electrode of the other transistor of the second matched pair and the emitter electrode of the latter is connected to said output node.

2. In the voltage regulator as claimed in claim 1 wherein said second matched pair comprises third and fourth NPN transistors.

3. In a voltage regulator as claimed in claim 2 wherein the second transistor of the first matched pair comprises an NPN transistor having an emitter electrode and with the base and collector electrodes shorted together and wherein the base electrodes of the second matched pair of transistors are connected, respectively, between the collector electrode of said second transistor and positive supply voltage and between the emitter electrode of said second transistor and the collector electrode of said first transistor.

4. In a voltage regulator as claimed in claim 3, additionally including a fifth and sixth NPN transistor each having emitter, base, and collector electrodes with the collector electrode of the fifth transistor connected to the positive supply voltage and its base electrode connected to the emitter electrode of the third NPN transistor and to the collector electrode of the fourth transistor and its emitter electrode connected to the collector electrode of the sixth transistor through a resistance means and to the base electrode of said first transistor so that the voltage across said resistance means is held insensitive to supply voltage and the voltage level of the output node is established.

5. In a voltage regulator as claimed in claim 4, said temperature compensating circuit including a negative temperature compensating circuit and a positive temperature compensating circuit, said negative temperature compensating circuit comprising a seventh NPN transistor and second and third resistance means, the collector electrode of said seventh transistor being connected to the positive supply voltage and the emitter electrode being connected to reference voltage through said second resistance means and to the base of the first transistor through said third resistance means, said positive temperature compensating circuit comprising said sixth transistor and an eighth NPN transistor and fourth and fifth resistance means with the emitter of the sixth transistor being connected to the reference voltage through said fourth resistance means and the collector thereof being connected to the base of the first transistor, and the emitter of the eighth transistor being connected directly to the reference voltage and its base and collector being shorted to form a diode and the shorted connection being connected to the base of the first transistor and to the fifth resistance means and to the output node.

* * * * *